US005558333A

United States Patent [19]

Kelson et al.

[11] Patent Number: 5,558,333

[45] Date of Patent: Sep. 24, 1996

[54] GOLF GAME DATA RECORDER, ANALYZER, AND GAME IMPROVER USING DISPLAY SIMULATIONS WITH PLURAL RESOLUTIONS

[76] Inventors: Steven M. Kelson, 5412 Ranger Dr., Rockwall, Tex. 75087; Robert E. Kelson, 2409 Knights Bridge Dr., Grand Prairie, Tex. 75050

[21] Appl. No.: 158,759

[22] Filed: Nov. 30, 1993

[51] Int. Cl.[6] ..... A63B 69/36; G06F 161/00

[52] U.S. Cl. ..... 473/131; 364/411; 463/1; 473/407

[58] Field of Search ..... 364/410, 411; 273/176 A, 176 R, 185 B

[56] References Cited

U.S. PATENT DOCUMENTS

| | | | |
|---|---|---|---|
| 3,665,494 | 5/1972 | Baumoel | 235/156 |
| 4,086,630 | 4/1978 | Speiser et al. | 364/410 |
| 4,192,510 | 3/1980 | Miller | 273/176 A |
| 4,343,469 | 8/1982 | Kunita et al. | 273/185 A |
| 4,504,055 | 3/1985 | Wells | 273/85 G |
| 4,505,478 | 3/1985 | Reithmiller | 273/32 H |
| 4,815,020 | 3/1989 | Cormier | 364/709.11 |
| 4,928,973 | 5/1990 | Perry et al. | 273/176 A |
| 5,056,791 | 10/1991 | Poillon et al. | 273/185 B |
| 5,095,430 | 3/1992 | Bonito et al. | 364/410 |
| 5,127,044 | 6/1992 | Bonito et al. | 379/88 |
| 5,184,295 | 2/1993 | Mann | 364/410 |
| 5,221,082 | 6/1993 | Curchod | 273/185 A |
| 5,245,537 | 9/1993 | Barber | 364/410 |

OTHER PUBLICATIONS

PGA Tour Golf, Poly Games and Electronic Arts, 1992.

AV Systems, Inc, "Golf" simulated game, 1992 Jan. 25, 1 sheet.

GolfMaster/2000 programs by Focus/2000, May 1990 to 1993 Jan. 20.

*Primary Examiner*—Gail O. Hayes
*Assistant Examiner*—Frantzy Poinvil
*Attorney, Agent, or Firm*—David Pressman

[57] ABSTRACT

The system uses a microcomputer (81) to provide a practical and useable graphic representation of the fairways (12) and greens (11) for any golf course in order to record shot locations (14) and measure playing performance during an actual round of golf as contrasted to a simulation of a golf game. A player will interact with the diagrams produced by the system's software and illustrated on a display or monitor (80). The design of the system enables the player to accurately determine the locations of all shots and calculates and displays:

(a) shot or club distances (FIG. 6 );

(b) shot or club accuracy (within 1–2 yards) to the center of the green from ball locations (14) ranging up to 200 yards from the center of the green;

(c) shot or club accuracy (within 1–2 feet) to the pin (cup location) from ball locations (14) ranging up to 200 yards from the center of the green even though the pin location may be different each time the course is played;

(d) statistical data, i.e., score, fairways hit (68), greens in regulation (69), a correctable swing analysis (71), and a complete short-game analysis (54) of putting (63, 64, 65, 66), sand saves (60, 61, 62), and chipping (55, 56, 57, 58, 59); and (e) playback of golf rounds (FIGS. 3 A, 35, 3C) so that improvement can be measured and selected courses played in the past can be reviewed and analyzed.

9 Claims, 9 Drawing Sheets

Microfiche Appendix Included
(31 Microfiche, 1000 Pages)

CLUB DISTANCES

| CLUB | LONGEST SHOT | AVERAGE DISTANCE | NUMBER OF SHOTS |
|---|---|---|---|
| SAND WEDGE | 57 | 44 | 4 |
| P WEDGE | 56 | 48 | 7 |
| 9 IRON | 81 | 69 | 5 |
| 8 IRON | 111 | 84 | 15 |
| 7 IRON | 143 | 99 | 15 |
| 6 IRON | 124 | 108 | 10 |
| 5 IRON | 161 | 123 | 18 |
| 4 IRON | 146 | 130 | 10 |
| 3 IRON | 154 | 115 | 3 |
| OTHER WOOD | 179 | 140 | 39 |
| THREE WOOD | 226 | 161 | 49 |
| BRASSIE | 210 | 162 | 124 |
| DRIVER | 291 | 203 | 182 |

DEPRESS <ENTER> TO QUIT

FIG. 6

GOLF GAME DATA RECORDER, ANALYZER, AND GAME IMPROVER USING DISPLAY SIMULATIONS WITH PLURAL RESOLUTIONS

An appendix of 31 microfiche and 1000 pages is attached to this specification and is contained in the file wrapper of this patent.

BACKGROUND

1. Field of the Invention

The invention relates computer systems and methods for use in the game of golf, particularly to a computer method for creating a universal golf course to enable accurate and graphic display of shot accuracy and distance for each club used in an actual round of golf to help players improve performance.

BACKGROUND

2. Description of Prior Art

Golfers strive continually to improve their play, i.e., lower their scores. One major way they do this is to record data about actual play of a round of golf on a course and thereafter analyze the results at home.

In order to utilize the results of a round of golf to help improve performance, a golfer had been forced to keep handwritten documentation of all shots played. Then the golfer had been faced with the difficult and time-consuming task of manually organizing the data and breaking down the results achieved with each club.

College golf coaches also use various methods of recording statistical data for their student players in an attempt to improve individual and team performance. As this normally requires considerable time and effort on the part of the students to complete data sheets, many of them dislike the task. Generally, the student's data sheets are sent to a data processor and several days elapse before the results are known. The results come back in the form of printouts which generally include information such as average score per round, average number of putts per round, number of birdies (holes played in one stroke under par), etc. However, the results are delayed and normally not available for use during a current tournament. Also, nothing is provided regarding accuracy and distance accomplishments with each club used in play. It is generally acknowledged that knowing proper club selection, and knowing one's average distance with each club, can help to improve one's performance at all levels of playing proficiency.

Computer games have been offered which provide entertainment for computer players to test their computer skills against the hypothetical playing of famous golf courses around the world. In some of these games, each hole has been meticulously duplicated so the computer player can get a feel of the golf course.

U.S. Pat. No. 4,504,055 to Wells (1985) shows an electronic video game adapted for use to play a simulated game of golf. Wells's game is a competitive one where the players compete on a fixed course and play by selecting clubs, directions, and strengths of shots. This machine plots successive lays of the ball. However, this type of computer activity merely provides entertainment and does not aid in the improvement of one's golf playing ability.

U.S. Pat. No. 5,184,295 to Mann (1993) shows a computer program and system for teaching a student how to play a game, specifically golf, in a superior manner. It compares a video of the student performing with a model compiled from a plurality of elite performers in order to teach the student what to do to improve play and emulate the superior model. Consequently, this system is dependent upon the physical ability, coordination, and aptitude of the student to correctly emulate the model in order for the student to improve.

U.S. Pat. No. 4,343,469 to Kunita et al. (1982) shows a computerized putting simulator where the computer considers the velocity and hit angle of the ball on the topography of the green and plots a trajectory of the putted ball. This putting practicing machine is designed merely to help a golfer improve putting performance, not general golf play.

U.S. Pat. No. 4,815,020 to Cormier (1989) shows a hand-held computer attached to a hand-held cart holding a golfer's bag and clubs. The computer computes the club to be used on the next stroke based upon previous strokes and the distances achieved with such clubs. Also, the remaining distance to the green is computed based upon the distance traveled thus far, which is measured by a sensor attached to a wheel of the golf cart. In most competitive college golf tournaments the players are required to carry their bags and clubs, and if not required, it's a common practice in high school golf competitions. This fact, plus the increasing use and requirement of motorized riding carts on most golf courses, limits the practical application of the Cormier device. In addition, Rule 14-3 of *The Rules of Golf* (The U.S. Golf Association, Jan. 1, 1992) states: "Except as provided in the Rules, during a stipulated round the player shall not use any artificial device or unusual equipment: . . . b. For the purpose of gauging or measuring distance or conditions which might affect his play . . . ". Thus, Cormier's device may be illegal in USGA tournaments.

U.S. Pat. No. 5,056,791 to Poillon et al. (1991) shows a system for use indoors to simulate outdoor play. The player hits the ball into a frame which has a hole of the real golf course projected on a screen in the rear of the frame. The computer senses the characteristics of the hit ball, including trajectory, velocity, and spin, and computes the actual travel it could take on the real course in an unimpeded environment which may or may not simulate varying conditions such as wind, rain, and temperature under actual playing conditions. Pictures of holes of a plurality of real courses are stored in the computer on a CD-ROM.

U.S. Pat. No. 5,221,082 to Curchod (1993) shows a system very similar to Poillon's, but where the player's shots are enhanced by a predetermined factor in order that the player will be competitive with other players.

U.S. Pat. No. 4,086,630 to Speiser et al. (1978) shows a computer-type golf game which works in conjunction with a slide projector to present successive scenes of the course and hole in play, hole distances, and lays of the ball, and completion (yards to go) to the pin. Speiser describes an unrealistic simulation whereby an out-of-bounds drive occurs when a ball hits a side wall of the drive range with an insufficient impetus on the rebound to activate the net switches. This example clearly illustrates a difference between simulated golf play and real golf play. In actual play such a shot may or may not result in an out-of-bounds situation. Most golfers readily agree that hitting golf balls during actual play on a course, especially in competition, is different from hitting balls on a driving range, or taking practice swings at an imaginary or real target such as a dandelion, or taking golf swings in a simulated environment.

Further, distances representing hits measured by these simulators are not hits of golf balls during actual golf play subject to usual variances in temperature, wind, and other atmospheric conditions. Instead, they are simulations which are physically measured by various types of sensing devices including sound wave detectors, and sensors measuring velocity, trajectory, and spin of the ball.

Also, these systems require simulation of play on specific golf courses. Because each golf course throughout the world is different from other courses in layout, design, and distances for each hole, it is exceedingly difficult to duplicate each layout as an instructional aid in the teaching of golf. To meet the needs of all golfers across the country, a great deal of time and expense would be required to enable the system to simulate the varied and numerous courses. The cost of these devices practically prohibit the average, individual golfer from owning and using or practicing with such devices. In addition to the relative high cost of such devices for individual golfers, most golfers prefer actual play rather than simulations of play.

U.S. Pat. No. 3,665,494 to Baumoel (1972) shows a handicap computer which takes into account the previous scores of the player and the courses where these scores were posted. This computer uses a punch card for input, which by today's standards, is impractical or obsolete. Handicaps are used to equalize competition, generally among members of golf clubs. For example, a scratch (zero) handicap player will give a seven handicap player seven strokes to equalize play in a round of golf. Other than indicating relative playing proficiency compared to other golfers, this device does nothing to improve a golfer's playing ability.

Sports Performance Research of Loveland, Colo. provides a computer statistical quality control system (1992) for golfers which presents a method of recording the distance of a golf shot, prior to making the shot, based on a player's estimate of the distance from the ball location to a target. In many cases, especially on a golf course with which a player is unfamiliar, such an estimate could be inadequate. This statement is verified by the user's manual which states: "If you can't make a good estimate of the distance, it is better to leave this column blank than to enter a poor guess."

Another instruction states: "Make an entry in the Yards to Target column whenever you can make a reasonable estimate of the distance from your ball to the pin." In view of the fact that pin locations are regularly moved daily, unless a player is informed of the exact location of each pin on each green, accurate estimates are further impaired.

In addition, the calculation of distances is further complicated by the requirement: "If you are making a shot from behind the green, enter a minus sign in front of the distance you enter. This notation tells GolfSQC [the associated program] your previous shot was hit too far."

This system uses a data gathering procedure requiring the use of specific, detailed Stroke Logging Charts and uses charts and graphs to display results of individual golf play. The system creates a profile of a golfer's game so the golfer can compare performance with a profile of professional golfers and others; however, the user's manual warns: "if less than 50% of your holes don't fit the templates or the round estimates are a lot different than your typical scores, GolfSQC probably isn't for you."

Studying charts and graphs offer little appeal or interest for most athletes or golfers, especially young people. This is an important consideration in the design of a golf improvement system. Many leading golf teachers feel, that in order to reach top levels of performance in golf, students must develop interest and be encouraged at a relatively early age.

AV Systems, Inc. of Santa Barbara, Calif. provides a computer game (1992) which can simulate several courses with several players.

Focus/2000 and Golfmaster/2000 of Shawnee, Kan. (1990,1992) provide a computer program for calculating and retaining scores for a day or a season. It can record hole and stroke play, golfer statistics, etc.

However, both of the latter two games suffer from most of the disadvantages of the devices of the above-described patents.

OBJECTS AND ADVANTAGES

Accordingly several objects and advantages of the present system are:

(a) to provide an appealing, relatively low cost, time efficient, and easy-to-use system, which provides the capability for analysis of a current day's play with a complete performance analysis of individual and team players for a round of golf played on any eighteen-hole course in the world;

(b) to provide a universal golf hole which facilitates the foregoing object and which can be used to simulate any golf hole in the world;

(c) to provide a playback capability, i.e., a record which can be reviewed upon demand and provide a graphical picture of each shot location in a round to aid a player's memory recall and visualization of each shot;

(d) to provide, as a result of the foregoing object, the means to enable any golfer, including professional golfers, to recall how they played the same course a previous year;

(e) to provide reports and graphical pictures of shot accuracy, e.g., approach shots to the green from distances ranging from 1 to 200 yards;

(f) to provide accurate information to help a golfer learn the average and maximum distances the golfer can hit each club under playing conditions, and (g) to provide a system that will operate on standard microcomputers widely available and easily accessible at relatively low cost to help golfers of all handicaps improve performance.

Several additional objects and advantages are:

(h) to provide reports on demand to enable golfers to evaluate progress or improvement; and (i) to provide a teaching/learning tool for a player, coach, or teaching professional which is fun to use.

Further objects and advantages will become apparent from a consideration of the ensuing description and accompanying drawings.

DRAWING FIGURES

FIG. 6 is an illustration of a Club Distances report selected from the main menu.

REFERENCE NUMERALS IN DRAWINGS

| | |
|---|---|
| | 01 strokes to reach green |
| 02 problem identification | 03 optional notation |
| 04 hit fairway or green | 05 clubs used to reach green |
| 06 distance to center of green after shot #1 | 07 distance to center of green after shot #2 |
| 08 distance of putt #1 | 09 number of putts |
| 10 yardage markers | 11 green |
| 12 fairway | 13 tee box |
| 14 golf ball | 15 200 yard fairway |
| 16 width of fairway | 17 shot-by-shot display |
| 18 hole number | 19 hole yardage |
| 20 information on golf courses played | 21 enter data for a round of golf |
| 22 patterns for approach shots to the pin | 23 results and analysis |
| 24 club distances | 25 instructions |
| 26 playback | |
| 30 distance of putt | 31 circumference of green |
| 40 yardage ranges | 41 number of attempts to reach the green |
| 42 club identification codes | |
| 50 player identification | 51 period covered |
| 52 average figure per round | 53 number of rounds in analysis |
| 54 short game | 55 distance of chip/pitches |
| 56 distance of putt after chip/pitch | 57 number of chip/pitches |
| 58 number of chip/pitch saves | 59 percentage of chip/pitch saves |
| 60 number of sand shot attempts | 61 number of sand shot saves |
| 62 percentage of sand saves | 63 number of putts per round |
| 64 number of putts per hole | 65 percentage of total putts from four distance ranges |
| 66 percentage of one putts from each distance range | 67 ball striking |
| 68 percentage of fairways hit | 69 percentage of greens in regulation |
| 70 hole performance based on comparison to par | 71 correctable swings |
| 72 average number of correctable swings | 73 a type of correctable swing (slice) |
| 80 display monitor | 81 computer with memory |
| 82 keyboard | 83 exit to dos |

SUMMARY

In accordance with the present invention, we provide a golf play analysis system which is operated on a hand-held, laptop, or a standard desktop microcomputer with a screen and data entry keys. The screen of the computer provides a diagram of a universal golf course which can portray any golf hole, regardless of shape or size. The computer's keys are used to enter data about the game, including the measurements of the course, clubs used, and shots made on each hole, etc. The system records and displays the recorded data so that a player can analyze and improve current play and also past games to improved future play.

DESCRIPTION—FIG. 1—SCORECARD

The present system is used to record data about and analyze a golfer's game and then improve the golfer's game. During actual play, specific information is recorded during or after the play of each hole and therafter the data is entered into the system and it provides selective outputs which help the golfer analyze and improve performance.

Figure 1:
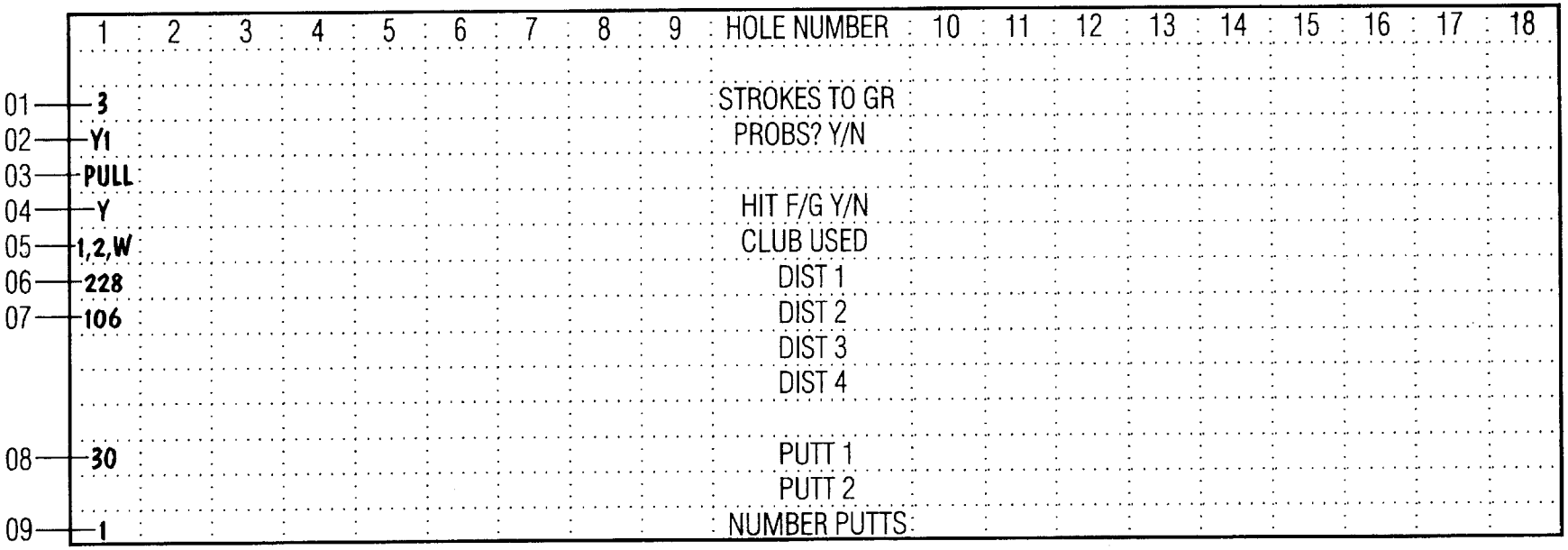
FIG. 1 is an illustration of a scorecard used by a player during actual play of a round of golf to record information for subsequent entry into a computer system, in accordance with the invention.

FIG. 1 illustrates a sample paper or cardboard scorecard, similar to a standard scorecard (not shown), which shows specific items recorded. Proficient golfers develop an ability to remember most of the shots and details from a round of golf and may not necessarily require written notation of all items shown in FIG. 1. However, the scorecard of FIG. 1 is organized in the order of data entry required by the system. Therefore, use of written data on a scorecard similar to that illustrated in FIG. 1 will facilitate and, in most cases, lessen the time required for data entry into the computer system. The scorecard has been partially completed with data of a player's performance on hole #1 of a course and will now be reviewed.

Row 01 (Strokes to Gr) illustrates that three strokes were taken on hole #1 to reach the green.

Row 02 (Probs? Y/N) illustrates that yes (Y), the player had a problem with or considered shot #1 to be less than satisfactory and thus noted the problem with the identification Y1 (Y=yes; 1=shot #1).

Row 03 illustrates an optional note made by the player that the problem on Row 02 with the shot was caused by a "pull."

Row 04 (Hit F/G Y/N) illustrates that yes (Y) the player's tee shot landed in the fairway.

Row 05 (Club Used) illustrates that a 1-Iron (1) was used for shot #1, a 2-Iron (2) was used for shot #2, and a Pitching Wedge (W) was used for shot#3.

Row 06 (Dist 1) illustrates that the distance remaining to the center of the green after shot #1 was 228 yards. The player obtained this distance as explained below.

Row 07 (Dist 2) illustrates that the distance remaining to the center of the green after shot #2 was estimated by the player to be 106 yards.

Row 08 (Putt 1) illustrates that the distance of the first putt was 30 feet.

Row 09 (Number Putts) illustrates that the player took one putt to complete play of the hole.

During play the golfer refers to existing yardage markers which are provided on most courses to measure the distance remaining to the center of the green. This measurement clarifies a key concept in using the system, which on each shot until the player reaches the green is: "How far is my ball from the center of the green?" (This concept is modified slightly on par 5 holes over 475 yards. Where necessary on par 5 holes, the player or player's caddy will pace (measure) the distance of the drive and note the distance on the scorecard with an identifying "T", i.e. 237T, to indicate the shot was measured 237 yards from the tee. When the data is entered into the computer system, on holes over 475 yards, the system will provide a graphic reference line of 200 yards from the tee for the player to use in placing the location of the tee shot.)

Normally on most holes, the golfer will note the location of each shot relative to the nearest yardage marker by either stepping off or estimating the variance from the marker. This is a common practice by most proficient golfers anyway, and thus does not alter a golfer's traditional habits and concentration which is so important and vital to good performance in competitive golf.

The scorecard of FIG. 1 is specially printed for use with the present system; however, this scorecard is not a requirement of the system. A standard scorecard (not shown), available at any golf course, can easily be modified or adapted for recording the data illustrated in FIG. 1.

DESCRIPTION—FIG. 2—COMPUTER

Normally, at a convenient time following the actual round of golf, the data on the sample scorecard is entered into a computer system which has been programmed to perform the functions discussed below.

A computer 81 (FIG. 2) having a keyboard 82 and a display monitor 80 is programmed with thirty-one mutually interrelated programs and units which perform all of the functions described and are included in the appendix of this application in the form of microfiche. The complete object codes of these programs appear in the microfiche appendix. These programs and units are written in the Pascal programming language, compiled on the Borland Pascal Compiler, version 7.0, including the Borland Graphics Interface, and may be run on a personal computer with hard disk storage, having an MS-DOS operating system, version 3.2 or greater, with a mouse or trackball and VGA display capabilities.

To initiate or start the system, at the "C:\" prompt of the MS-DOS operating system, a player types: "cd\GOLF." This instruction means: "Change the directory on disk drive "C" (The hard drive) to GOLF." This instruction changes the prompt to "C:\GOLF>."

The player again types "GOLF" which will bring up the main menu on Screen 80. Main menu 80 illustrates the functions of the master program which controls all of the programs and units in the system and allows the player to selectively choose operations.

When an operation is completed the system automatically returns to The main menu to allow the player to continue with other selections or exit to the DOS operating system (line 83 of menu ) .

The system is programmed in two versions to accommodate a color or a black-and-white display.

When the main menu appears on the display a highlight bar is superimposed over the first or top item on the menu. The highlight bar, indicating desired selection, may be moved to other selection items by either moving the mouse or using arrow keys (not shown on keyboard 82)

Item 25 ("INSTRUCTIONS") provides a menu (not shown) of instructions as to how to proceed and operate the system.

A player will initially proceed by selecting menu item 20 ("INFORMATION ON GOLF COURSES PLAYED"). This item is selected by moving the highlighting bar over this menu selection; and, when the mouse button is pressed or the ENTER key (not shown) is pressed, the computer will display another menu which includes the item ("ENTER DATA FOR A NEW COURSE NOT IN DATA BASE"). Selection of this item provides specific instructions regarding the information that must be entered about each golf course played. Information about a specific course being played, such as name of the course plus distance and par for each hole, is normally printed on a standard scorecard (not shown) for the course. Taking the information from this standard scorecard, the player enters into the system through keyboard 82 the name of the course, plus the distance and par score for each of the eighteen holes. Normally, this information is entered only once for each set of tee boxes for each golf course. Then it is retained by the system and is available for future use. However, the distance for each hole can optionally be entered after each round to allow for normal, minor changes of tee box markers. The system can accommodate course measurements from several tee boxes, as is common to most golf courses, i.e., Championship Tees, Regular Men's Tees, Ladies' Tees, etc. For each round the player enters an identification number, date, comments, and course name.

Figure 2:
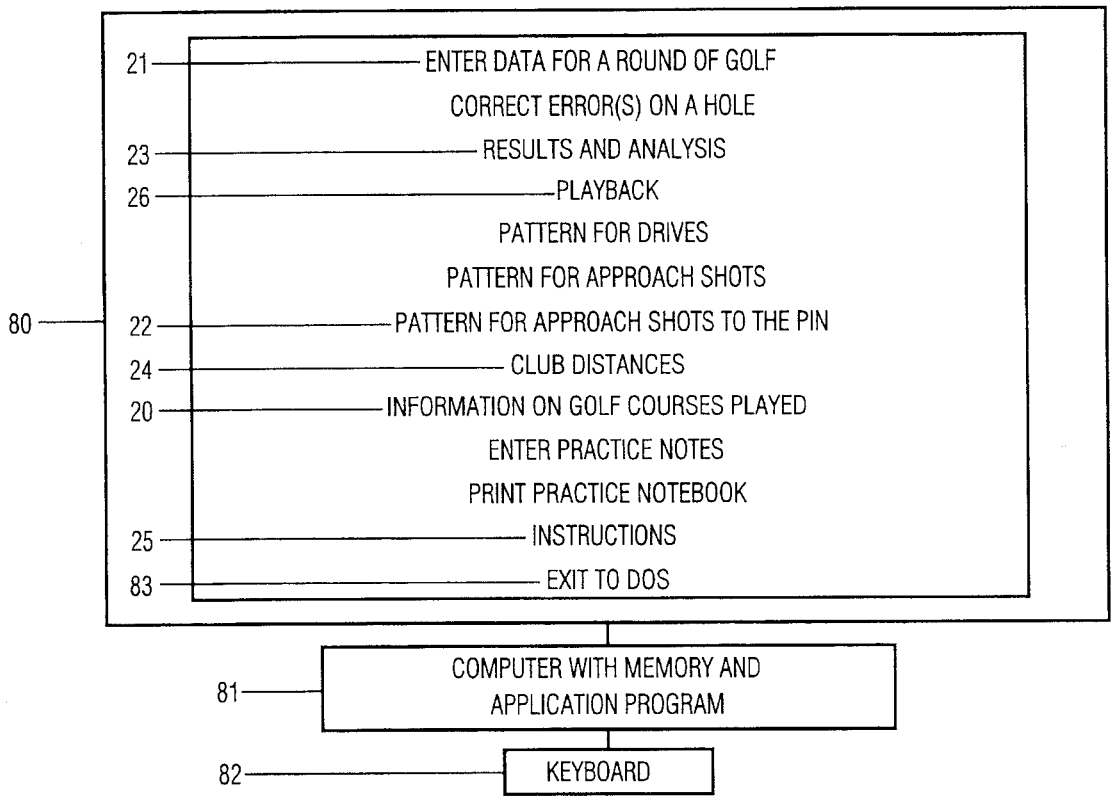
FIG. 2 is a diagram of a computer system with a display and keyboard showing a main menu which provides options offered by the system.

The player next selects item 21 ("ENTER DATA FOR A ROUND OF GOLF") from the main menu. The system then guides the player sequentially, hole by hole, through an eighteen-hole round of golf. To facilitate data entry, the system asks the player on each hole to respond to the following requests presented sequentially in the same order, as illustrated in the sample scorecard (FIG. 1):

1. ENTER NUMBER OF STROKES (incl. PENALTY STROKES) TO REACH GREEN #1. For example, Row 01 (FIG. 1) illustrates that "3" should be entered through keyboard 82 (FIG. 2).

2. IF YOU HAD A PROBLEM ON THIS HOLE—SAND, BAD LIE, OBSTRUCTION, HAZARD, PENALTY, OR POOR SWING, SELECT YES or NO.

If YES is selected, the system brings-up a screen in which the player must identify the number(s) of the stroke(s) with a problem, i.e., 1st Stroke, 2nd Stroke, etc.

Then the system brings up a screen which asks the player to select the most applicable description for each problem shot from the following selection menu: Correctable swing, Sand/bunker shot, Behind tree/obstruction, Hit tree/obstruction, Bad lie or heavy grass/rough, Out-of-bounds or lost ball, Lateral or water hazard, Uneven lie, Penalty stroke.

For example, Row 02 (FIG. 1) indicates a problem with the first shot and that a selection should be made. Optional selection of "Correctable swing" will bring up a screen which asks the player to select the most applicable description of the shot pattern: Fade, Draw, Push, Pull, Slice, Hook, Push Slice, Pull Hook, Fat, Thin, Stub, Top.

Row 03 (FIG. 1) illustrates that Pull should be selected. (This information is used for analysis purposes.)

After the foregoing information is entered, or if NO is selected, the system moves on to the next request.

3. DID TEE SHOT HIT FAIRWAY OR GREEN—SELECT YES or NO. For example, Row 04 (FIG. 1) illustrates that YES (Y) should be selected.

4. ENTER, IN SEQUENCE, THE CLUB USED FOR EACH STROKE (NOT incl. PUTTS) ON THIS HOLE. A penalty stroke is identified on this screen and is treated the same as a club selection. A menu of club selections is presented to the player. Row 05 (FIG. 1) illustrates that the 1-Iron (1)should be selected first followed by selections of the 2-Iron (2) and the Pitching Wedge (W).

5. ENTER NUMBER OF PUTTS FOR HOLE. Row 09 (FIG. 1) illustrates that "1" should be entered.

OPERATION—FIG. 3A—SCREEN A—UNIVERSAL HOLE

Figure 3A:
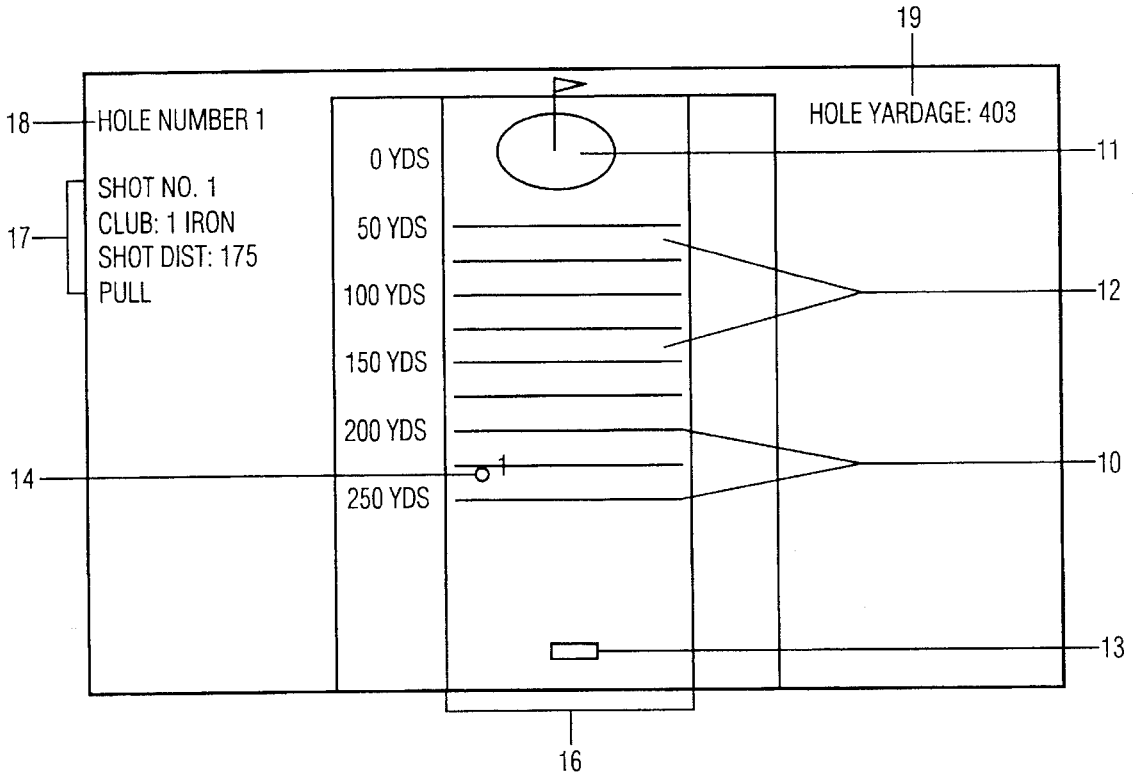
FIG. 3A is an illustration of a computer screen showing a first view of a universal golf hole, in accordance with the invention.

After entry of the above information for each hole, the system will automatically display the screen illustrated in FIG 3A, which represents a first view of a universal golf hole. Hole number 18 and yardage of hole 19 are automatically displayed. Because the length of each hole was previously entered, Screen A will allow for the length of any golf hole from the center of a green 11 up to 700 yards measured to the back of a tee box 13. Fairway 12 represents a fairway width 16 of 100 yards; this is sufficiently large to simulate the width of any fairway.

A player using the system will quickly realize the important factor of accurate representations and calculations of distances, especially in accomplishing the object of determining club distance achievements. No attempts are made to depict bad lies from contour of the land, or exact locations of trees and sand traps, etc. Such variances are provided for under the menu selections previously illustrated. In other words, if a tee shot lands in a sand trap (not shown in the fairway), the player selects Sand/Bunker Shot from the menu for the next shot (the shot used for getting out of the bunker) to identify the problem. Also, if the player is in a rough which is only 25 yards from the center of the fairway and the player had a problem with the shot, the problem can be identified as Bad Lie or Heavy grass/rough similar to the Sand/Bunker Shot described in the previous sentence. Regardless of where the shot is illustrated on the screen, the system is designed to accommodate the many variances common to the game of golf.

Most golf courses have 250-, 200-, 150-, and 100-yard markers 10 on each fairway indicating the distance from the marker to the center of the green. As also indicated, during actual play, the player records, by either stepping off or estimating the distance from the nearest marker after each shot, on the data card of FIG. 1, the remaining distance in yards to the center of the green for each shot until the green is reached. In accordance with the current rules of golf which, for handicap purposes, limit the player to a maximum of eleven strokes per hole, the system allows a maximum of seven shots to reach the green and a maximum of four putts.

As illustrated in FIG. 3A, a green 11 is always located near the top of the screen. A fairway 12, between the green and tee box 13, will adjust its length, measured in yards, from the center of the green to the back of tee box 13. The spacing between the green and the tee box adjusts itself to accurately represent the length of each hole in accordance with the hole data previously entered. Using a standard computer mouse or trackball (not shown), the player sequentially places the ball on the screen at the point where each shot stopped. In addition, a shot-by-shot display 17 is illustrated on the screen, indicating shot number, club used, distance of shot, and variables affecting the shot.

A simulated golf ball 14 appears at the location adjacent the number of each shot on the hole. The number "1", shown on the fairway at 14, indicates that the first shot has been made and landed at spot 14. The screen variables representing the locations are stored in memory and used for the calculation of distances between each shot.

Row 06 (FIG. 1) indicates the distance remaining to the green. With the exception of a tee shot on a par 5 hole over 475 yards, the player will reference yardage markers 10 and with the mouse or trackball will place the ball where the first shot stopped which is illustrated by Row 06 (FIG. 1) to be 228 yards from the center of the green. The tee box and the center of the green are always located at exactly the center line or horizontal mid-point of the display illustrated in FIG. 3A.

In the representation of all holes, green 11 is always at the same distance from the top of the screen and tee box 13 is placed on the screen based on the length of the hole which was previously entered.

Normally, each shot will be either right or left of the center line of the fairway and the system uses the logic of right triangle geometry to calculate other distances. When a shot 14 is displayed on the screen, the system has been supplied with the following data:

(a) The distance 19 of the hole in yards measured from the center of green 11 to the back, center of tee box 13.

(b) The distance in yards from the ball to the center of the green.

The system makes an additional measurement:

(c) The distance in yards from the ball to the center of the fairway.

Then, using the right-angle geometric theorem that the hypotenuse squared is equal to the sum of the squares of the other two sides, the following additional functions are performed:

(d) A calculation of the distance in yards for the shot just made.

(e) Storage of each shot distance by club used.

Using the logic just described, the system knows for each shot when the remaining distance to the center of the green is less than 200 yards. When this occurs the system will automatically replace the screen of FIG. 3A with the screen of FIG 3B.

FIG. 3B—SCREEN B—UNIVERSAL HOLE—200 YARDS TO GREEN

Figure 3B:
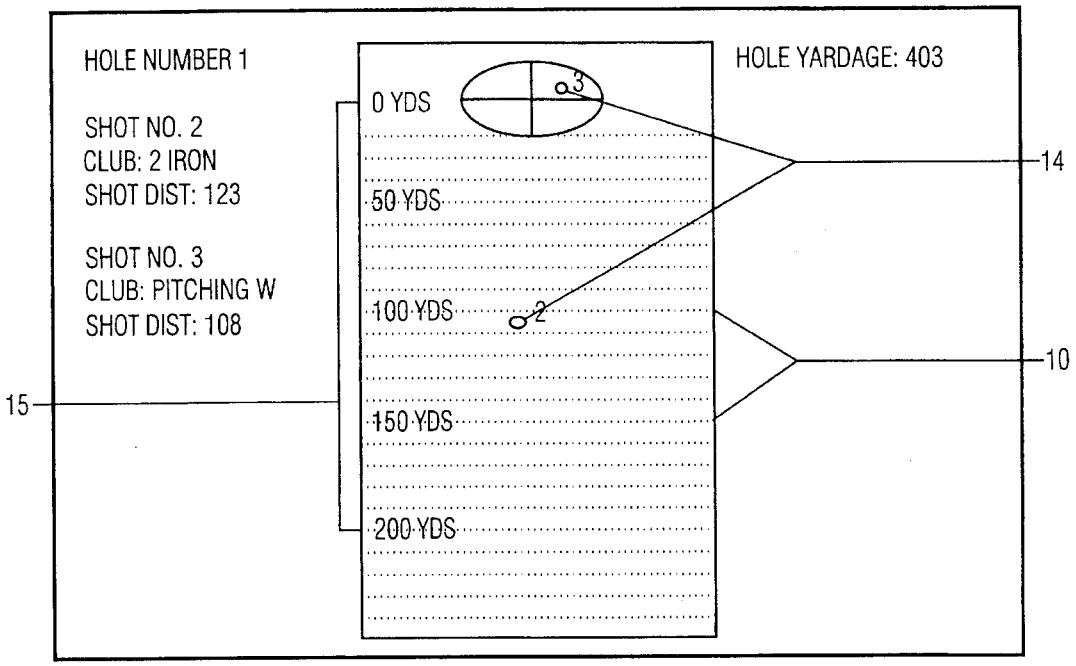
FIG. 3B is an illustration of a computer screen showing a second view of the universal golf hole and the accuracy of approach shots to the center of the green with distance measurements in yards.

The second leg or view of the universal golf hole is illustrated in FIG. 3B. A major advantage of Screen B is the ability to accurately place shot locations within a human tolerance error of 1–2 yards. A fairway length 15 is magnified by the system to simulate a distance of 200 yards from the center of the green to the 200 yard marker. Therefore, the available area to pin-point shot locations has been proportionately increased in size.

The first shot on any hole, regardless of distance, will first be placed on Screen A (FIG. 3A). However, whenever any shot gets within 200 yards of the center of the green, the system will automatically switch to the screen of FIG. 3B and the shot will then appear on Screen B. Note the location of shot 2 at spot 14 in FIG. 3B. When the switch of screens occurs, the system automatically relocates this shot from Screen A to the same relative position on the fairway shown in FIG. 3B. This replacement of the ball on Screen B visually assists the player to quickly locate the area on the new screen where the ball is to be placed.

In the example shown in FIG. 3B, the ball replacement is in exactly the same relative location as originally placed in FIG. 3A and therefore perfectly covers the first ball.

A major objective of proficient golfers is accuracy of shots from 200 yards to the green.

Proper club selection is an important factor in achievement of this objective. The reason for this second placement is to benefit from the magnified display and thereby help the player achieve maximum accuracy in all ball placements within 200 yards of the center of the green.

Thus, ball placements on the screen of FIG. 3B can be made more accurately, i.e., easily within 1 to 2 yards for the purposes of golf analysis.

Screen A provides yardage markers 10 at 50-yard intervals interspersed with equidistant measuring lines at 25-yard intervals. Screen B provides the same yardage markers 10, but are interspersed with equidistant measuring lines at 10-yard intervals to enable and facilitate more accurate ball placements.

The system will calculate exact distances from and to the locations on the screen where each ball is actually placed. However, slight human errors in the physical placement of the ball locations possibly may occur until experience and proficiency is gained in using the system. Measurement of drives off the tee do not demand an error tolerance factor as critical as 1–2 yards and thus the screen of FIG. 3A is a satisfactory measuring device. However, proficient golfers are very concerned with pinpoint accuracy from 200 yards to the green. The combination of the screens of FIGS. 3A and 3B enables the analyzer to be a complete and viable measuring device for the game of golf.

Figure 7:
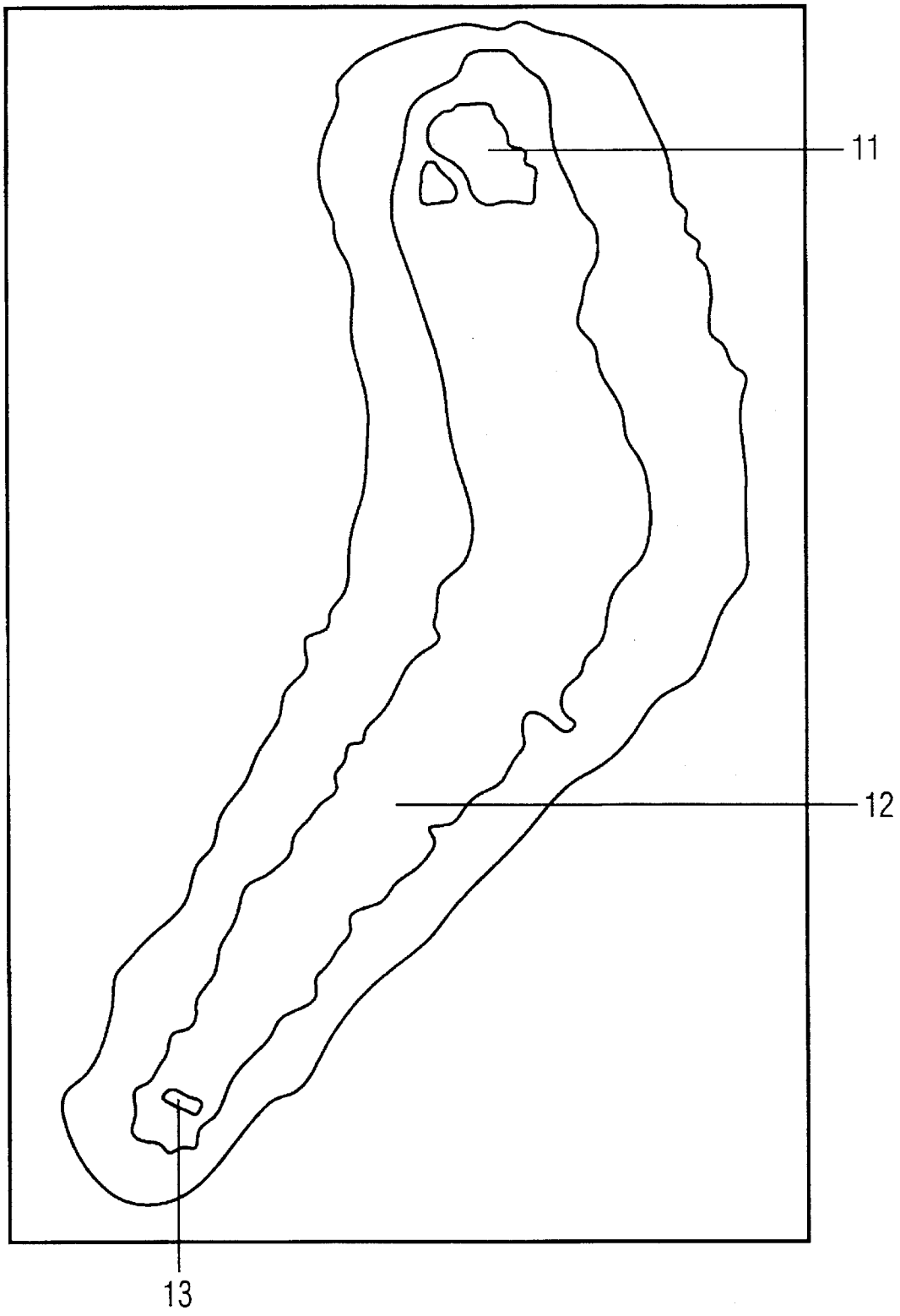
FIG. 7 is an illustration of a golf hole with a curved fairway, commonly referred to as a dogleg.

Another major advantage of Screen B provides the ability to adjust to the measurement of curved fairways, or excessively curved fairways, commonly referred to as doglegs. FIG. 7 illustrates a typical par 4 golf hole with a dogleg fairway. Page 32 of the *USGA HandiCap System . . and Golf Committee Manual*, effective Apr. 1, 1991 through 1994, regarding course measurements, states: "Usually a hole with a bend (dogleg) should be measured on a straight line from the tee to the center of the fairway at the bend. From there the measurement should be on a straight line to the center of the green." Each fairway shown in FIGS. 3A and 3B is measured on a straight line from the tee on a straight line through the center of the fairway. Therefore, in compliance with the above reference, we simulate a fairway with a dogleg (FIG. 7) through creation of two separate straight fairways (FIGS. 3A and 3B) to adjust for the curve. The result provides accurate fairway measurement for a simulation of any golf hole, including a hole with curved or dogleg fairway.

On page 48 of *The Rules of Golf*, "stroke" is defined as ". . . the forward movement of the club made with the intention of fairly striking at and moving the ball . . . " By definition in this application, both shot and penalty strokes are considered to be a stroke.

Figure 3C:
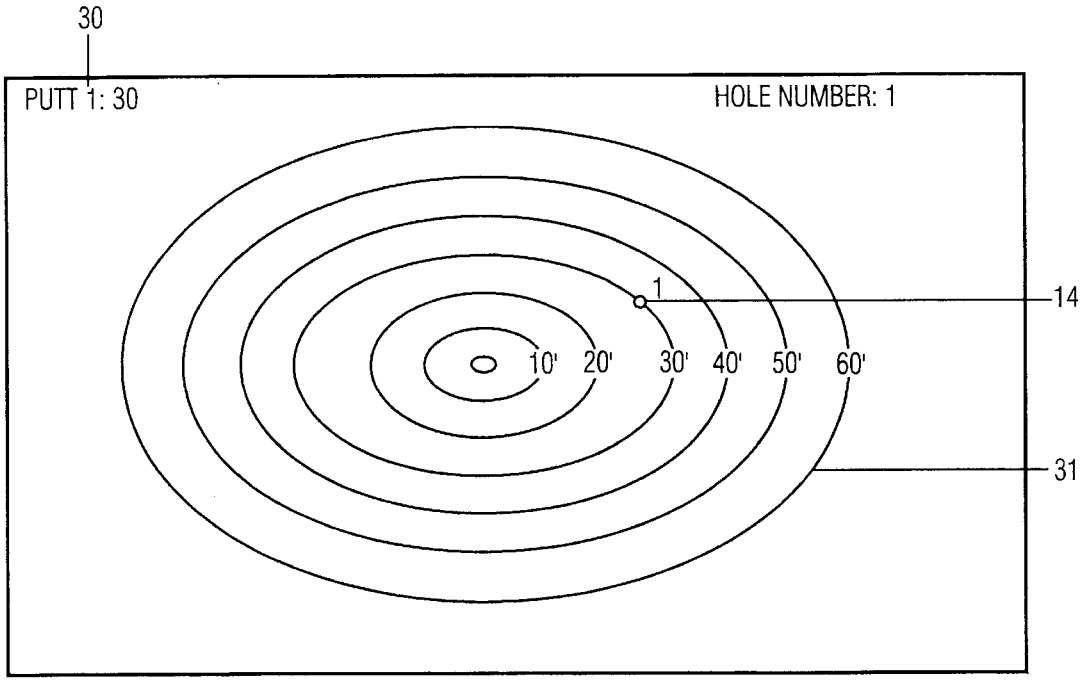
FIG. 3C is an illustration of a computer screen showing a third view of the universal golf hole which illustrates a green with distance measurements in feet.

The number of strokes to reach the green have previously been entered; therefore, when the number representing the most recent ball placement by the player is equal to the number of strokes to reach the green, the system automatically brings up the green of FIG. 3C (Screen C). However, prior to bringing up Screen C, the player is requested to select, from a menu, the number of putts taken on the hole, ranging from one to four putts or the alternative selection of "Holed out from off the green"indicating zero or none putts. For example, if a player took only one stroke to reach the green, and made the putt selection of "Holed out from off the green," the result would be the prestigious Hole-in-One!

FIG. 3C—SCREEN C—UNIVERSAL HOLE—GREEN

Screen C (FIG. 3C) represents the third view of the universal golf hole. Screen C is magnified (enlarged) to accurately simulate measurements on a green in feet. The apogee of oval 31 (representing the green) simulates 60 feet from the middle of the oval, which is the cup. Therefore, the maximum distance in the system for any putt is 60 feet. This distance provides ample distance to simulate long putts and also provides a screen size sufficiently large to accurately place the ball within a human, placement margin error of 1–2 feet.

Golfers agree there's not much difference between 60- and 70-foot putts, so this is not a significant disadvantage. For all practical purposes 60 feet is ample to allow for most long putts.

For purposes of clarity, FIG. 3C includes display of concentric circles in 10-foot intervals from 10 feet up to the 60-foot apogee of oval 31. These circles are labeled 10', 20', 30', 40', 50' and 60' to aid the player in placing the ball in exactly the correct location.

Most golfers attempt to get their first putt within three feet of the cup so a target circle is also placed three feet around the cup. The distance in feet of each putt 30 is displayed in the upper left hand corner of Screen C. Once the ball is on a green, no further reference to the center of the green is necessary; instead, all ball locations, directions, and distances are relative to the pin or cup location.

When a ball reaches the green during actual play we recommend that the player step off the distance from the ball to the hole to get an accurate distance of the first putt, and note the relative direction from the pin. As illustrated at 14 of FIG 3C, the ball is located to the right of the pin. For example, even though a pin (cup location) may be located near the front of a green, and Screen C always shows the pin (cup location) located in the middle, the player merely places the putt on Screen C at the spot 14, representing the relative direction and distance from the pin where the ball was actually located on the green during play.

Essentially, regardless of a pin's location during play, the system allows for a putt of 60 feet in any direction from the pin.

An accurate measurement of the first putt on a green is important because the system will use this figure to subsequently analyze and display the accuracy of shots to the pin, measured in feet, from shots as far out as 200 yards.

In analysis, the system will start with the distance of the first putt on the green, then essentially back-up or go in reverse to determine the club used to get to the green plus the distance of the shot. The same technique is used to analyze the "short-game" or those parts of the game known as chipping, pitching, putting, and greenside sand play. These are major advantages of the system. In exactly the same manner as used in the previous screens to illustrate ball locations, the putts are similarly positioned with the mouse or trackball. Accuracy of measurements on the green are practically and easily provided within 1–2 feet.

FIGS. 3A, 3B, 3C—PLAYBACK

A complete playback or reproduction of a round of golf for any or all of the holes played and recorded with the universal golf hole (FIGS. 3A, 3B, and 3C) is available on demand by the player through selection of item 26 ("PLAYBACK") on the main menu (FIG. 2). Golf ball 14 locations (FIGS. 3A, 3B, and 3C) for each shot, including their associated shot-by-shot displays 17 (FIGS. 3A and 3B), are available for viewing on monitor 80. This capability offers a sequential, hole-by-hole replay of a complete round or an optional individual replay of any selected hole. A menu selection "Exit" allows the player to return to the main menu.

Proficient golfers like to review their outstanding rounds and recall their strategy of course management and club selections on selected golf courses. For example, a replay of a hole played a year ago in a particular tournament may offer the reminder: "Oh yes, now I remember, the thirteenth green is elevated and I used a 4-Iron rather than a 5-Iron on the final day to get a birdie and win the championship!"

Professionals, top amateurs, colleges, and high schools annually play tournaments at specific golf courses. The playback feature offers the capability to review how a course was played in the past to provide information for improved course management and club selection in the future.

FIG. 4—PATTERNS FOR APPROACH SHOTS TO THE PIN

Figure 4:
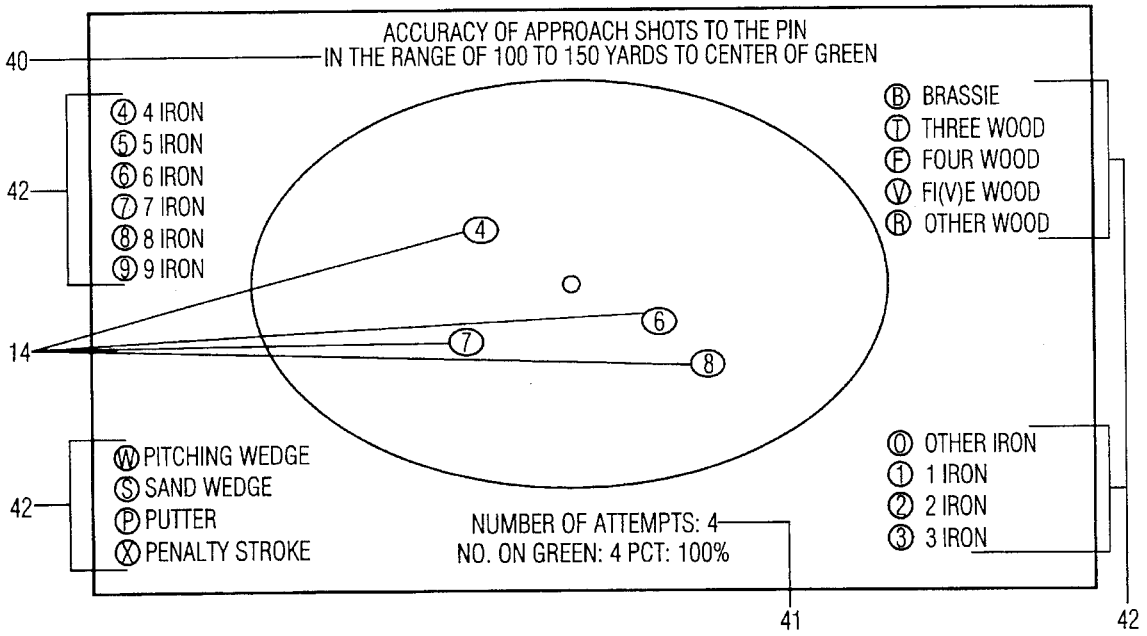
FIG. 4 is an illustration of a screen selected from the main menu showing the accuracy of approach shots to the pin from distances ranging up to 200 yards from the center of the green, including accuracy measurement of the shots within 1–2 feet.

FIG. 4 shows an analysis screen which can be initiated on demand at any time through selection of menu item 22 ("PATTERNS FOR APPROACH SHOTS TO THE PIN"). This selection will allow the player to obtain a graphical picture of all shots reaching the green for distances up to 200 yards from the green. The player can select any two distance parameters equal or greater than one yard and equal to or less than 200 yards. A range of 100 to 150 yards is indicated at 40.

FIG. 4 further shows at 41 that four attempts to reach the green were made within the distance parameters of 100 to 150 yards and that all four attempts were successful, for an accuracy percentage of 100%.

FIG. 4 further illustrates the locations of the four balls 14 which reached the green relative to the pin (cup location), and the number identification inside each ball 14 represents the club used for each shot. Identification codes 42, representing types of golf clubs, are also shown.

This display clearly presents a graphical picture of approach shots to the pin and answers several questions for a golfer such as:

(a) What is my accuracy of approach shots from various distances and therefore what shots do I need to work on?. For example, shots clustered to right of the pin may indicate to a right-handed player a tendency to hit slices. Slices are shots which end up to the right of the player's target because the face of the club was moving from right to left creating a left to right spin on the ball at the time of impact. Depending upon the situation, the player may elect to correct the slice, or as an alternative, continue to play the slice but allow for a correction to achieve more accuracy.

(b) Are my shots short, long, left, or right of the pin and therefore what should I do to correct this?. For example, shots clustered short of the pin may indicate the player is "underclubbing", i.e., the player should use a 5-Iron, which is a longer club and has a more shallow pitch which will hit a ball further, in place of a 6-Iron.

(c) What clubs give me the best accuracy from various distances?. Each ball on the green is identified by the club used. Therefore, the player can efficiently and critically analyze the results achieved with each club used.

(d) Am I showing improvement?. The system provides a comprehensive answer to the last question (d) because, not only can the golfer compare the results of each round, the system can also combine results of rounds and show all shots for the last month, or last tournament of four rounds, or overall team results if desired.

RESULTS AND ANALYSIS REPORT

Figure 5:
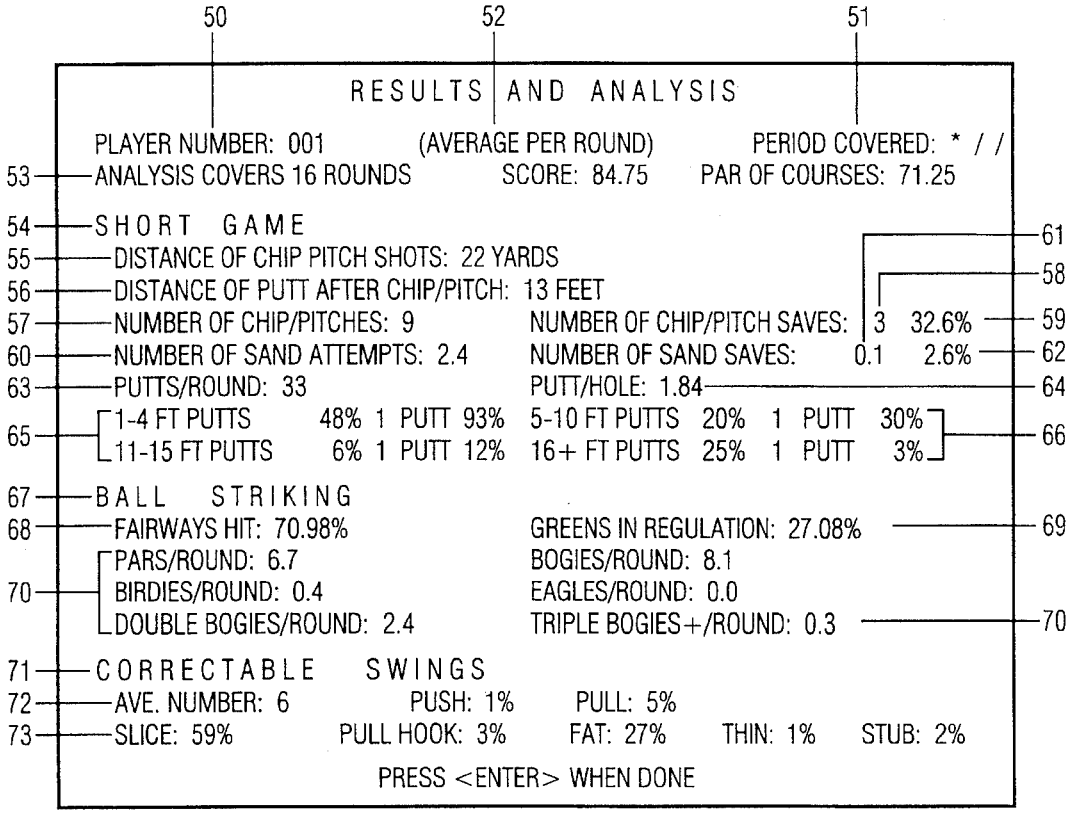
FIG. 5 is an illustration of a Results and Analysis report selected from the main menu.

The results and analysis report shown in FIG. 5 provides a thorough analysis of a golfer's play. This report is initiated by selection of item 23 ("RESULTS AND ANALYSIS") on the main menu.

This report is available on demand whenever main menu 80 appears.

By entering player identification (player number) 50 and the date of the round 51 shown in FIG. 5, the system will present a report for the round played on the date entered in the format illustrated.

However, note at 53 that the analysis shown covers 16 rounds. Also note that item 51, the period covered (date), has an asterisk (*) in the first position. This example informs the system to: "Include all the rounds recorded for this player."As an example, this feature can also be used to report rounds for a month or a year. In other words, the system has broad and extensive report capabilities. This fact has great importance when considering the use of this system for evaluating progress in the process of learning and improving. Whether the report shown in FIG. 5 is a report on one round or several rounds, the report calculates an average FIG. 52 for each item so as to report the results as they would apply to a single round. Players want to know their average score relative to one round of golf, not necessarily their cumulative scores. For example, a score for one round is reported as the actual score for the round; however if the report included two rounds with scores of 80 and 70, the average score of 75 would be reported. The report is categorized by three sections: The first section 54 covers the short game, i.e., that phase of the game comprised of chipping, pitching, putting, and sand play. For all putts and successful shots to a green from distances up to 35 yards from the center of the green the system will calculate and report the:

55 distance in yards of chip/pitch shots

56 distance in feet of the putt after chip/pitch

57 number of chip/pitches

58 number of chip/pitch saves

59 percentage of chip/pitch saves

60 number of sand shot attempts

61 number of sand shot saves

62 percentage of sand shot saves

63 number of putts per round

64 number of putts per hole

65 percentage of total putts from four distance ranges

66 percentage of one putts (successfully making first putts) from each distance range The system incorporates a unique method to determine accuracy of shots to the pin (cup location), even though the pin location may be different each time the hole is played. The information illustrated above provides a means for the student to improve overall "short-game" performance, i.e., golf play from a distance of 35 yards to the center of the green which includes, putting, chipping, pitching, and greenside sand shots. Many proficient golfers regard chips, pitches, and putts as a "short-game"0 which is interrelated. Putting performance is often dependent upon performance of chipping and pitching i.e., the better the chip, the closer the first putt to the hole, the better the putting performance. The present system calculates the average distance in feet of the first putt for all successful shots to the green from 35 yards out, and the average distance of the resulting putts. This information tells the player whether practice on putting or chipping/pitching will be more beneficial to future performance. Additional information is provided regarding performance of sand play and putting performance from four different distance ranges to pin-point putting deficiencies and help the player determine what length of putt should be practiced.

The second section 67, which is comprised of driving and approach shots, is referred to as the "ball striking" phase of the game. The system will calculate and report on the following items:

68 percentage of fairways hit from tee shots on non par-3 holes

69 percentage of greens hit in regulation, i.e.,
1 shot for a par-3 hole
2 shots for a par-4 hole
3 shots for a par-5 hole 70 hole performance based on comparison to par
Number of pars
Number of birdies (one less than par)
Number of eagles (two less than par)
Number of bogies ( one more than par )
Number of double bogies (two more than par)
Number of triple bogies (three more than par)

The third section 71 deals with an analysis of problems caused by less than perfect or less than satisfactory swing patterns; we categorize these as "correctable swings". Most golfers at nearly all levels of playing ability know when they hook a shot or hit a slice. Most golfers can properly identify the type of shot they hit. The real key and objective for most golfers is correcting the problem that causes the errant swing in the first place. Most often the treatment to cure the problem requires teaching or instruction by a knowledgeable coach and/or teaching professional. This report is a valuable tool for the teaching professional because it provides a comprehensive picture of the student's game.

For the student who hits the tee shot down the middle of the fairway 250 yards and smartly hits the approach on the green, there is no problem. And, for these types of shots the system will automatically record and retain the distance for each club used. However, when the student badly slices the ball off the tee into the rough on the right for a distance of 147 yards, the student has the option of declaring the shot as a correctable swing and identifying the shot as a slice. If the student elects to declare the shot a correctable swing, the shot will not be recorded or included in the distance measurements for the club used, but the shot will be included as a shot in the slice pattern category for correctable swings.

The following swing patterns or problem shots are included in correctable swings: Fade, Draw, Push, Pull, Slice, Hook, Push Slice, Pull Hook, Fat, Thin, Stub, Top. The system reports at 72 the average number of correctable swings for each round and the percentage of each pattern as compared to the total recorded. Only those correctable swings selected by the player will appear on this report. As indicated at 73, the correctable swings were slices.

The screen illustrated in FIG. 5 may be printed on paper as a permanent record by depression of the shift and print screen keys (not shown) on keyboard 82.

FIG. 6—CLUB DISTANCES

Distances achieved with each club are illustrated in FIG. 6. This report is initiated through selection of item 24 ("CLUB DISTANCES") on the main menu. This report is available on demand whenever the main menu appears, and can be produced for each round, all rounds in a month, or all rounds for each golfer or a team of golfers. For all shots over 50 yards from the center of the green the longest and average distances are calculated for each club used during the round. These distances are retained for each round and available for combination with previous rounds for evaluation of progress. For the coach or teaching professional the system can provide for data storage and reporting for up to and including 999 students.

The screen illustrated in FIG. 6 may be printed on paper as a permanent record by depression of the shift and print screen keys.

CONCLUSION, RAMIFICATIONS, AND SCOPE

The reader will see that we have provided a system utilizing a microcomputer, which shows any selected golf course and a complete portrayal and analysis of data of a round of play so that golf shots can be easily and accurately recorded. This provides significant advantages to the golfer in that it provides information on the player's ability regarding distance and accuracy for each club used during actual play;

it provides graphical pictures of shot accuracy from distances up to 200 yards within a measurement factor of 1 to 2 feet;

it stores data so that results can be compared and progress measured;

it provides a playback of golf rounds so that selected courses played in the past can be reviewed and analyzed. A playback feature will illustrate each shot and putt for each hole for any round recorded in the system and re-display the information as illustrated in FIGS. 3, 4, & 5; and it provides the coach or teaching professional with a teaching tool to motivate students and accurately measure progress.

Although the description above contains many specificities, these should not be construed as limiting the scope of the invention but as merely providing illustrations of the presently preferred embodiments of this invention. For example, the system is presently programmed to run under the Microsoft MS-DOS (Disk Operating System) operating system, but can also be programmed for newer, and other operating systems, including the Macintosh operating system and the Microsoft Windows operating system. The screens can be projected on television and movie-type screens in addition to the computer monitor. The system can also be operated on future laptop and hand-held models of microcomputers. The system will operate on standard laptop microcomputers which are portable and can be carried on a golf course. However, as stated, it is very likely that a computer system will not be permitted under current rules. It is very possible that scorers and other golf officials, not actually playing, may use the system. If permissible, the data can be entered on a hand-held computer (instead of the scorecard) during play and thereafter transferred to a desktop computer.

Thus the scope of the invention should be determined by the appended claims and their legal equivalents, rather than by the examples given.

We claim:

1. A system for analyzing, calculating, and displaying results from a person's actual, physical play of any selected hole of a plurality of golf course, regardless of the length and shape of said golf hole, comprising:

a computer having a display, a memory, a data entry means, and means for providing display simulations with plural resolutions for entering data recorded from said person's actual play into said memory for enabling an accurate replication of said actual play of said golf course hole, said computer being arranged to show a simulation of a fairway of a golf course hole, said simulation of said fairway including a simulation of a green and a plurality of equidistant markers on said fairway that display measurements from the center of said green, a simulation of a tee box, and a simulation of the distance from said center of said green to said tee box, and display means in said computer for displaying said golf course hole in the following three sequential views:

a first view displaying the total length of said golf course hole, measured in predetermined measurement unit from said center of said green, said computer containing means for showing a golf shot placement by a human physical act using a pointing device within a golf course hole placement resolution that is relatively small compared to the length of said golf course hole as displayed on said display means in said first view, thereby providing a visible measurement of said golf shot after said placement, and a second view displaying a magnified simulation of that part of said golf course hold from said center of said green measured down a center line of said fairway to simulate a relatively long fairway distance to accommodate a bend to dogleg in said fairway, said computer containing means for enabling said person to show a golf shot placement within a fairway placement resolution that is relatively small compared to the length of said fairway as displayed on said display means in said second view, and a third view displaying a magnified simulation of said green to enable said person to show a putt placement on said green within a green placement resolution that is relatively small compared to the size of said green as displayed on said display means in said third view.

2. The system of claim 1, further including means in said computer for allowing said person to show an accurate golf shot placement in said second view within said fairway placement resolution that allows for simulation of a human tolerance error of about two yards and to show an accurate putt placement in said third view within said green placement resolution that allows for simulation of said human tolerance error of about two feet.

3. The system of claim 1, further including means in said computer for accurately displaying patterns of said shots using screen locations on said computer display representing said person's placements of said golf shots.

4. The system of claim 1, further including means for calculating and displaying said view of said fairway in the form of a rectangle and calculating and displaying said view of said green in the form of a circle.

5. A method for accurately and automatically adjusting for different pin or cup locations on the green of any hole of a plurality of golf courses in a replication of actual play on said golf courses, comprising:

providing a computer having a display, a memory, a data entry means, and means for using display simulations with plural resolutions to enable entering data, recorded from a person's actual play of said golf courses, into said memory for enabling an accurate said replication of actual play, and providing on said display two different scales of measurement for allowing said person to show golf shot placements on a fairway on said display by a human manipulating a pointing device using a fairway placement resolution that is relatively small compared to the length of said fairway and to show putt placements on said green on said display using a green placement resolution that is relatively small compared to the size of said green.

providing three different views displaying magnified simulations of said hole, whereby accuracy from said golf shots can be displayed in measurement of said green placement resolution without having to enter different screen coordinates, use external devices, or modify said recording or operating procedures to compensate or allow for different said pin locations, regardless of said pin locations on said green of said golf courses.

6. The method of claim 5, further including providing on said display a resolution for enabling said person to show a golf shot placement within said fairway placement resolution that allows for simulation of a human tolerance error of about two yards and to show a putt placement within said green placement resolution that allows for simulation of said human tolerance error of about two feet.

7. The method of claim 5 wherein said computer is arranged to display accuracy of an approach shot to a pin on said green of said golf course by club and by selection of distance parameters.

8. The method of claim 5 wherein said computer is arranged to display a short game analysis, including accuracy to the cup for putting chipping, pitching, and greenside sand play.

9. The method of claim 5 wherein said computer is arranged to display said fairway in the form of a rectangle and display said green in the form of a circle.

* * * * *

UNITED STATES PATENT AND TRADEMARK OFFICE

CERTIFICATE OF CORRECTION

PATENT NO. : 5,558,333

DATED : Sep 24, 1996

INVENTOR(S) : S. M. Kelson and R. E. Kelson

It is certified that error appears in the above-indentified patent and that said Letters Patent is hereby corrected as shown below:

On the title page, item [57], Abstract, l. 24, change "35" to —3B—.

Col. 6, l. 39, change "(1)" to —(1)—.

Col. 9, l. 7, change "16 of 100" to —16 of 100—.

Col. 10, l. 65, change "10" to —10—.

Col. 12, l. 1, change "60" to —60—.

Col. 13, l. 26, change "42" to —42—.

Col. 14, l. 23, change "80 and 70" to —80 and 70—.

Col. 14, l. 24, change "75" to —75—.

Col. 14, l. 54, delete "0".

Col. 14, l. 59, change "35" to —35—.

Col. 15, l. 12, change "70" to —70—.

Col. 16, line 57, Claim 1, l. 3, change "course" to —courses—.

Col. 17, line 9, Claim 1, l. 21, change "unit" to —units—.

Col. 17, line 19, Claim 1, l. 31, change "hold" to —hole—.

Col. 17, line 22, Claim 1, l. 34, change "to" to —or—.

Signed and Sealed this

Eighteenth Day of February, 1997

*Attest:*

Bruce Lehman

BRUCE LEHMAN

*Attesting Officer*

*Commissioner of Patents and Trademarks*